United States Patent [19]

Mazzoni et al.

[11] 4,233,796

[45] Nov. 18, 1980

[54] DESICCATED SPANDREL PANELS

[75] Inventors: Renato J. Mazzoni, Tarentum; Vernon A. Shoop, Springdale, both of Pa.

[73] Assignee: PPG Industries, Inc., Pittsburgh, Pa.

[21] Appl. No.: 963,075

[22] Filed: Nov. 22, 1978

[51] Int. Cl.[3] ..... E04C 2/54; E06B 7/12

[52] U.S. Cl. ..... 52/789; 52/172

[58] Field of Search ..... 52/788–792, 52/307, 308, 171, 172, 809, 172, 789; 428/34, 38; 156/107

[56] References Cited

U.S. PATENT DOCUMENTS

| | | | |
|---|---|---|---|
| 1,224,530 | 5/1917 | Goetzke | 52/789 |
| 2,193,207 | 3/1940 | Rosen | 52/307 |
| 3,156,975 | 11/1964 | Shaw | 52/809 |
| 3,758,996 | 9/1973 | Bowser | 52/172 |
| 3,971,178 | 7/1976 | Mazzoni et al. | 52/172 |

*Primary Examiner*—James L. Ridgill, Jr.

*Attorney, Agent, or Firm*—Donald C. Lepiane

[57] ABSTRACT

A hermetically sealed spandrel unit has a transparent sheet mounted in facing relationship to a metal sheet having a desiccant containing film mounted thereon.

15 Claims, 4 Drawing Figures

FIG. 1
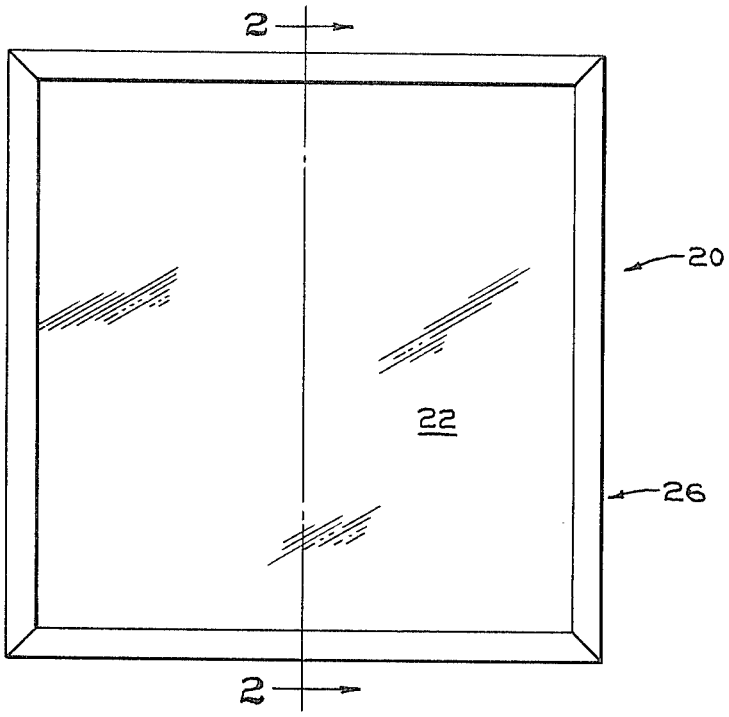
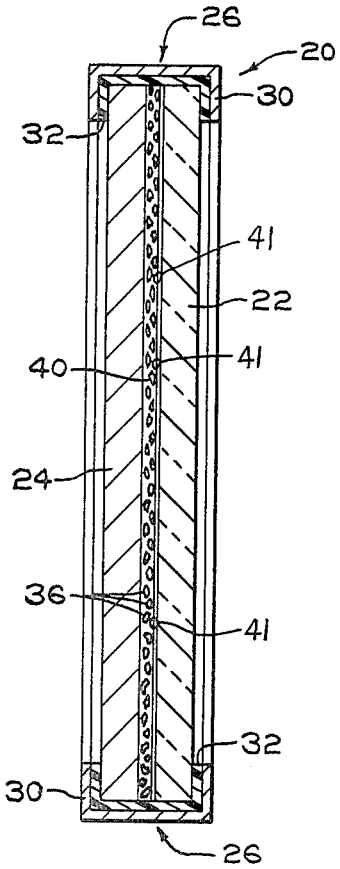
FIG. 2
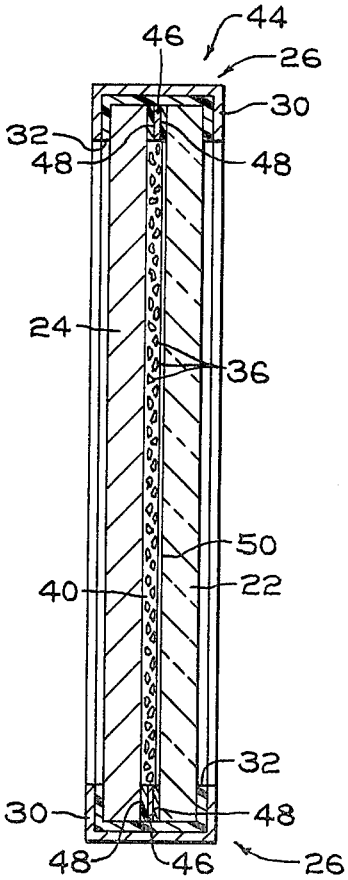
FIG. 3
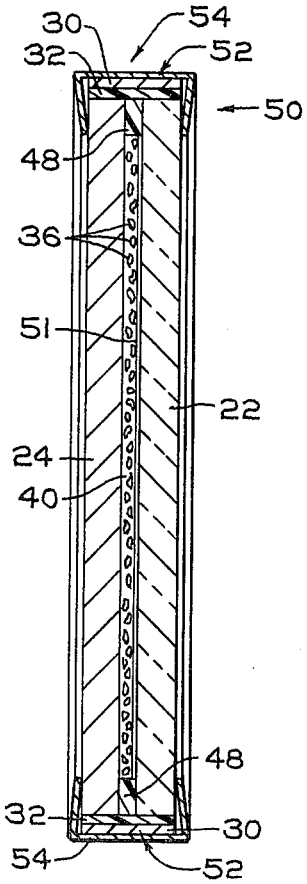
FIG. 4

DESICCATED SPANDREL PANELS

BACKGROUND OF THE INVENTION

1. Field of the Invention

This invention relates to architectural glazing units and, in particular, to opaque, insulating, hermetically sealed, glazing units known as spandrel panels.

2. Discussion of the Prior Art

U.S. Pat. No. 4,000,593 teaches a spandrel panel or unit for glazing spandrel areas of exterior walls of multistory buildings. The spandrel area as the term is used herein refers to opaque areas formed by spandrel panels as contrasted to the vision area of a curtain wall. Normally, the spandrel panels are either intrinsically opaque, e.g., as taught in the above-mentioned patent or rendered opaque by various backing or coating materials on transparent sheets e.g., as taught in U.S. Pat. No. 3,869,198.

In addition to selectively concealing a portion of the building structure, the spandrel unit taught in U.S. Pat. No. 4,000,593 has a hermetically sealed air space between a glass sheet and metal sheet to provide thermal insulation. A desiccant containing spacer spaces the sheets from one another and absorbs moisture in the air space between the sheets. In addition to the insulating properties, a hermetically sealed, dried air space is often needed to prevent moisture from attacking the coating on the inner surface of the glass sheet.

Although the spandrel unit taught in the above-identified patents are suitable, it would be advantageous to provide still another spandrel panel construction having a dry, hermetically sealed space between a pair of sheets.

SUMMARY OF THE INVENTION

This invention relates to a hermetically sealed spandrel unit having a pair of sheets each having a major surface in facing relationship with one another. A film containing a desiccant is mounted between the sheets. The film maintains the desiccant between the sheets while permitting access to the environment between the sheets. Facilities seal the facing major surface of the sheets and the film therebetween to prevent or minimize moisture from moving into the space between the facing major surfaces of the sheets.

This invention also relates to a method of fabricating insulated hermetically sealed spandrel units. One of a pair of sheets each having a major surface is provided with a desiccant on its major surface. Thereafter the major surfaces of the sheets are mounted in faced relationship to one another and the edges of the sheets sealed with a moisture-resistant sealant.

BRIEF DESCRIPTION OF THE DRAWING

FIG. 1 is a front elevated view of a spandrel unit incorporating features of the invention;

FIG. 2 is a view taken along lines 2—2 of FIG. 1;

FIG. 3 is a view similar to the view of FIG. 2 illustrating an alternate type of edge seal; and FIG. 4 is a view similar to the view of FIG. 2 illustrating still another type of edge seal.

DESCRIPTION OF THE INVENTION

In the following discussion like numerals refer to like elements. Shown in FIGS. 1 and 2 is a spandrel panel or unit 20 incorporating features of the invention. The unit 20 includes a first sheet 22 preferably a transparent sheet mounted in facing relationship to a second sheet 24 preferably an opaque sheet by a composite strip 26 which forms an edge seal. The transparent sheet 22 is not limiting to the invention and may be a glass sheet and/or a plastic sheet. The sheet 22 may be (1) tinted (colored), (2) coated and/or uncoated as taught in U.S. Pat. No. 4,000,593 which teachings are hereby incorporated by reference, and/or (3) a tempered or strengthened glass sheet. The opaque sheet 24 is not limiting to the invention and may be (1) a transparent sheet having an opaque coating such as taught in U.S. Pat. No. 3,869,198 which teachings are hereby incorporated by reference or (2) a metal sheet.

Composite strip 26 which maintains the sheets 22 and 24 in facing relationship is not limiting to the invention and preferably includes a continuous ribbon or foil 30 of a moisture-resistant material (essentially moisture impermeable), e.g., an aluminum foil having a sealant layer 32. Preferably, the sealant acts as an adhesive and a moisture-resistant barrier against moisture penetration. The sealant preferably acts as an adhesive to adhere the foil 30 to the peripheral edge portions and if desired, to the outer marginal edge portions of the sheets 22 and 24 as shown in FIG. 2. The sealant preferably acts as a moisture-resistant barrier to prevent moisture from moving between the sheets. The expression "moisture-resistant barrier against moisture penetration" as used herein refer to an ability to prevent passage of water vapor to such an extent that the spandrel unit is capable of being utilized in multiple glazed architectural installations. To qualify for such architectural use, the sealant should present enough of an obstacle to water vapor transmission to preclue condensation of water vapor in the interior of the unit at temperatures down to about 0° F. (−18° C.) i.e., about $4\times10^{-8}$ pounds of water per cubic inch ($1\times10^{-6}$ grams of water per cubic centimeter) of air in the unit and preferably lower over a period of several years. The time period required is at least about 3–5 years but preferably is at least about ten years and in optimum cases is at least about 20 years. The amount of water vapor penetration depends not only on the inherent moisture vapor transmission of the material employed as the barrier but also on the dimensions, e.g., thickness of the barrier and the path of the water vapor penetration.

In accordance to the teachings of the invention, moisture between the sheets 22 and 24, e.g., moisture trapped between the sheets during fabrication of the unit 20 is absorbed by dessicant 36 provided between the sheets. The desiccant 36 may be held between the sheets 22 and 24 by a matrix or film 40. The matrix or film 40 is not limiting to the invention but is selected to (1) hold the desiccant 36 in position between the sheets and (2) allow the desiccant to absorb moisture between the sheets 22 and 24. The following discussion amplifies the preceding. If the film or matrix 40 has a moisture vapor transmission value of 0 grams/24 hour/1 square meter/mil at 100° F. (38° C.) 90 percent relative humidity (R.H.) as determined by the Standard Methods of Test for Water Vapor Transmission of Materials in Sheet Form, ASTM designation E-96-66 Method E, the sieve size of the desiccant 36 and thickness of the film 40 are selected such that the desiccant 36 extends beyond the film thickness. For example, as shown in FIG. 2 portion 41 of the desiccant 36 extends beyond the surface of film 40. In this manner the desiccant 36 communicates with the moisture between the sheets to absorb same. If the film 40 has a moisture vapor transmission value of greater than 0 grams/24 hour/1 square meter/-mil at 100° F. (38° C.) 90 percent R.H. as determined by the above-mentioned ASTM test, the desiccant 36 may be covered or embedded in the matrix or film 40 and/or the desiccant may extend beyond the matrix or film surface. As can be appreciated by those skilled in the art, as the moisture vapor transmission value increases for a given desiccant the rate at which the moisture is absorbed increases and vice versa. Films or matrixes that may be used in the practice of the invention but not limited thereto are adhesives and sealants for example of the types taught in U.S. Pat. No. 3,971,178 which teachings are hereby incorporated by reference; paints, for example of the type taught in U.S. Pat. No. 3,037,963 which teachings are hereby incorporated by reference; shellacs, and matrixes made of polymeric materials having the desiccant dispersed therein, for example, of the types taught in U.S. Pat. No. 3,758,996 which teachings are hereby incorporated by reference.

The invention is not limited to the amount or type of desiccant used to absorb moisture between the sheets 22 and 24. It is recommended, however, that the desiccant remove sufficient moisture so that the spandrel unit 20 has a dew point value as determined by Standard Method of Test for Frost Point of Sealed Insulating Glass Units, ASTM designation E-546-75 commensurate with the geographical location in which the unit is to be used. More particularly, a dew point value of +5° F. (−15° C.) may be acceptable in geographical locations such as the Sun Belt whereas a +5° F. (−15° C.) dew point value would not be acceptable in areas such as Canada and Northern United States where temperatures are below freezing. In these areas, dew point values of about −60° F. (−51° C.) are normally recommended.

With reference to FIG. 3 there is shown a spandrel unit 44 similar to the spandrel unit 20 shown in FIG. 2 with the differences discussed below. The spandrel unit 44 has the sheets 22 and 24 held in spaced relationship by an elongated member 46 mounted between adhesive layers 48 to provide an air space 50 therebetween. The adhesive layers 48 may be any of the adhesives used in the art e.g., a silicon adhesive or a moisture resistant adhesive similar to the adhesive layer 32 of the composite strip 26. The elongated member 46 may be made of any material, e.g., plastic or metal. Further, the thickness of the member 46 is not limiting to the invention.

Referring now to FIG. 4, there is shown spandrel unit 50 similar to the spandrel unit 44 shown in FIG. 3 with the differences discussed below. The unit 50 does not have the elongated member 46 shown in unit 44 of FIG. 3 but has an adhesive layer 48 to provide a space 36 between the sheets 22 and 24. A composite strip 52 similar to the composite strip 26 shown in FIGS. 2 and 3 is mounted on the peripheral edge portions of the sheets 22 and 24. A U-shaped channel 54 of the type used in the art mounts the outer marginal edges of the sheets 22 and 24 while biasing the sheets 22 and 24 about the adhesive layer 48.

As can now be appreciated, the spandrel panel construction is not limited to the invention. For example, a coating may be provided on the inside and/or outside surface of the glass sheet. Further, two glass sheets may be used and the film containing desiccant colored to match the color of the vision panel. The advantage of this type of spandrel unit is that it may be mounted in any position because the color is the same from both sides.

DETAILED DESCRIPTION OF THE INVENTION

Three spandrel units were constructed in accordance with the teachings of the invention and their dew points measured at selected intervals from the time of fabrication. Each of the units had a glass sheet 22 and a galvanized steel sheet 24 each having a width of about 14 inches (35.6 centimeters) and a length of about 20 inches (50.8 centimeters). The glass sheet 22 had a thickness of about ¼ inch (0.64 centimeters) and the galvanized sheet 24 had a thickness of about 0.025 inch (0.064 centimeter). The glass sheet and galvanized sheet were conveniently cleaned to remove dirt and grease. A layer 40 of black paint of the type sold by PPG Industries, Inc. under the trademark DURACRON® was sprayed on the surface of the galvanized sheets. Molecular sieve was dusted on the coating of one sheet; silica gel dusted on the coating of a second sheet; and no desiccant was provided on the coating of the third sheet. The sheets were fired at a temperature of about 400° F. (250° C.) for a period of about 2 hours to dry the dessicant and paint. A glass sheet 22 was mounted on the coating 40 of the sheet 24. The edges of the sheets 22 and 24 were sealed with a composite strip 26 mounted on the peripheral edge portions of the sheets and extending over onto the outer marginal edge portions of the sheets 22 and 24 as shown in FIG. 2. The composite strip 26 included an aluminum tape 30 having a thickness of about 0.010 inch (0.037 centimeters) and a width of about 1¾ inches (4.45 centimeters) and a layer 32 of a moisture resistant adhesive having a thickness of about 0.030 inch (0.076 centimeter). The adhesive 32 is of the type taught in U.S. Pat. No. 3,971,178 which teachings are hereby incorporated by reference.

The assembled units were kept at room temperature for about 24 hours and thereafter the units were placed in an apparatus similar to that taught in Section 6.1.1 high humidity—ultra violet test chamber of Proposed Recommended Practice for Testing Seal Longevity of Sealed Insulating Glass Units, ASTM designation E-6, P-2 except that no ultra violet light was used. The units were dew point measured at selected intervals per the above-mentioned ASTM test.

Table I shows the dew point measurements of the three units. The unit without the dessicant had a 0° F. (−18° C.) dew point reading 24 hours after fabrication, whereas the unit having the molecular sieve had a negative dew point reading more than 11 days after fabrication and the unit having the silica gel had a negative dew point reading more than 78 days after fabrication. From the data shown in Table I, it is clear that moisture in the space between the sheets 22 and 24 is absorbed by the dessicant containing film or coating 40.

TABLE I

| | | Dew Point Measurements Taken at Time Periods Measured from Time of Fabricating Unit | | | | | | | |
|---|---|---|---|---|---|---|---|---|---|
| | 24 hours at Room Temperature | 4 days | 11 days | 18 days | 25 days | 43 days | 68 days | 78 days | 108 days |
| Unit having | −90 F. | −90 F. | −90 F. | −65 F. | −45 F. | −15 F. | −10 F. | −5 F. | +5 F. |

TABLE I-continued

| | 24 hours at Room Temperature | Dew Point Measurements Taken at Time Periods Measured from Time of Fabricating Unit | | | | | | | |
|---|---|---|---|---|---|---|---|---|---|
| | | 4 days | 11 days | 18 days | 25 days | 43 days | 68 days | 78 days | 108 days |
| silica gel on the film 40 | (−68 C.) | (−68 C.) | (−68 C.) | (−54 C.) | (−43 C.) | (−25 C.) | (−23 C.) | (−20 C.) | (−15 C.) |
| Unit having molecular sieve on the film 40 | −90 F. (−68 C.) | −90 F. (−68 C.) | −90 F. (−68 C.) | +10 F. (−12 C.) | +15 F. (−8 C.) | +30 F. (−1 C.) | — | — | — |
| Unit having no desiccant on the film 40 | 0 F. (−18 C.) | +15 F. (−8 C.) | — | — | — | — | — | — | — |

In general, units tested in the above manner and having a dew point of −5° F. (−20° C.) 35 days after manufacture are commercially acceptible for a period of at least about 10 years in geographical areas having a mean winter temperature of about −60° F. (−51° C.). For geographical areas having a higher mean winter temperature, the life of the unit increases and vice versa.

A second evaluation similar to the evaluation previously discussed was conducted. In the second evaluation only two units having dessicant containing films were constructed and tested as above discussed because the unit not having dessicant was shown not to be acceptible. Table II confirms the results of the first test shown on Table I namely, that the dessicant containing film 40 absorbs moisture from between the sheets and lowers the dew point reading. It is interesting to note that the unit having the molecular sieve had a relatively constant dew point measurement for more than 20 days after fabrication and then a marked increase in the dew point reading, whereas the unit having the silica gel had a relatively gradual increase in dew point. It is believed that the difference is due to the characteristics of the dessicant. More particularly, molecular sieve absorbs moisture and becomes saturated faster than the silica gel. Therefore, additional moisture that may move through the edge seal would not be absorbed.

As can now be appreciated, the invention is not limited to the type of dessicant used and/or to a particular dew point value, and as was discussed above, a selected dew point value is often determined by the temperature of the geographical area in which the unit is to be used.

TABLE II

| | 2 hours at Room Temperature | Dew Point Measurements Taken at Time Periods Measured from Time of Fabricating Unit | | | | | | | |
|---|---|---|---|---|---|---|---|---|---|
| | | 19 hours | 6 days | 13 days | 20 days | 38 days | 63 days | 73 days | 103 days |
| Unit having silica gel | −90 F. (−68 C.) | −90 F. (−68 C.) | −85 F. (−65 C.) | −40 F. (−40 C.) | −30 F. (−25 C.) | −15 F. (−25 C.) | −10 F. (−23 C.) | −5 F. (−20 C.) | +5 F. (−15 C.) |
| Unit having molecular sieve | −90 F. (−68 C.) | −90 F. (−68 C.) | −90 F. (−68 C.) | −90 F. (−68 C.) | −85 F. (−65 C.) | +30 F. (−1 C.) | — | — | — |

Units similar to those shown in FIG. 4 were constructed and installed in Golden, Colo. and in Spartanburg, S. C. during June 1978. The units 50 each had a glass sheet 22 having a thickness of about 0.250 inch (0.64 centimeter) and a galvanized steel sheet 24 having a thickness of about 0.030 inch (0.076 centimeter). The sheets were conveniently cleaned to remove dirt and grease. About 20 gallons (78 liters) of black paint of the type sold by PPG Industries Inc., under the trademark DURACRON® was mixed with about 10 gallons (39 liters) of Linde 10X molecular sieve powder. The resultant mixture by volume was about 22 gallons (100 liters). The paint containing the dessicant was sprayed onto the galvanized sheets. During spraying occasional blockage of the spray gun occured and additional stirring was required to minimize the blockage. To overcome the blockage problem, ½ gallon (2 liters) of the paint was mixed with ¼ gallon (1 liter) of the molecular sieve. The molecular sieve was added slowly over a period of about 1 hour while continuously stirring. The mixture was allowed to set for an additional hour and thereafter sprayed onto the galvanized sheets. Blockage of the spray gun was reduced.

The coated sheets 20 were fired to a temperature of about 400° F. (205° C.) for a period of about 2 hours to dry the paint and desiccant. A thin layer 48 of adhesive of the type taught in the above-mentioned U.S. Pat. No. 3,971,178 having a thickness of about 0.062 inch (0.16 centimeter) and a width of about 0.25 inch (0.64 centimeter) was flowed on the marginal edge portions of the coating applied to the sheet 24. The glass sheet was mounted on the adhesive layer and adhesive layer flowed to form a seal. The composite strip 26 was applied around the peripheral and marginal edges of the units as shown in FIG. 2. Units of various lengths and widths were constructed in the above manner and were installed. To date, no dew point measurements have been taken but visual inspection has been made and no condensation was observed.

As can be appreciated, the invention is not limited to the above examples which were presented for illustration purposes only.

What is claimed is:

1. A spandrel unit comprising:

a film containing a desiccant;

a pair of panels each having a major surface, the major surface of said panels facing one another with said film between and substantially coextensive with the major surfaces with said desiccant absorbing moisture between the major surfaces; and sealant means mounting said panels to provide a moisture-resistant barrier against moisture penetration between the major surfaces of said panels.

2. The spandrel unit as set forth in claim 1 wherein said desiccant extends beyond the surface of said film.

3. The spandrel unit as set forth in claim 1 wherein said film has a moisture vapor transmission value of greater than 0 grams/24 hour/1 square meter/mil at 100° F. (83° C.) 90% R.H.

4. The spandrel unit as set forth in claim 2 or 3 wherein said film is a coating of paint on the major surface of at least one panel.

5. The spandrel unit as set forth in claim 4 wherein one panel is a metal sheet and said coating of paint is on said metal sheet.

6. The spandrel unit as set forth in claim 1 wherein said film is adherent to the major surface of at least one panel.

7. The spandrel unit as set forth in claim 6 wherein said sealant means includes a composite strip having a moisture resistant adhesive on a foil; and said composite strip mounted on at least the peripheral edge portions of said panels.

8. The spandrel unit as set forth in claim 6 wherein said sealant means includes a layer of moisture-resistant adhesive between the marginal edge portions of the major surfaces of said panels.

9. The spandrel unit as set forth in claim 6 wherein said desiccant extends beyond a surface of said film.

10. The spandrel unit as set forth in claim 6 wherein said film has a moisture vapor transmission value of greater than 0 grams/24 hour/1 square meter/mil at 100° F. (83 C) 90% R.H.

11. The spandrel unit as set forth in claim 3 or 10 wherein said film is a polymeric material having desiccating particles dispersed therein.

12. A method of making a spandrel unit, comprising the steps of:

providing a pair of panels each having a major surface;

providing a film containing a desiccant on a major surface of at least one panel the film being substantially coextensive with the major surface of the at least one panel;

mounting the panels with their major surfaces in facing relationship to one another;

sealing the panels to provide a barrier against moisture penetration; and absorbing moisture between major surfaces of said panels by the desiccant containing film.

13. The method as set forth in claim 12 wherein said step of providing a film containing desiccant includes the steps of:

spraying a coating on the major surface of at least one of the panels; and providing a desiccant on the coating.

14. The method as set forth in claim 12 wherein said step of providing a film containing a desiccant includes the steps of mixing desiccating particles in a coating having a moisture vapor transmission value of greater than 0.1 grams/24 hours/1 square meter/mil at 100° F. (83° C.) 90% R.H. and flowing the coating on the major surface of the at least one panel.

15. The method of making a spandrel unit as set forth in claim 12 wherein said sealing step includes the step of providing a layer of moisture resistant sealant between marginal edge portions of the major surfaces of said panels.

* * * * *

UNITED STATES PATENT AND TRADEMARK OFFICE

CERTIFICATE OF CORRECTION

PATENT NO. : 4,233,796

DATED : November 18, 1980

INVENTOR(S) : Renato J. Mazzoni and Vernon A. Shoop

It is certified that error appears in the above-identified patent and that said Letters Patent are hereby corrected as shown below:

Column 8, line 25, Claim 14, "0.1 grams" should be --0 grams--.

Signed and Sealed this

*Third* Day of *March 1981*

[SEAL]

*Attest:*

RENE D. TEGTMEYER

*Attesting Officer*

*Acting Commissioner of Patents and Trademarks*